US009090419B2

(12) United States Patent
Hirahara

(10) Patent No.: US 9,090,419 B2
(45) Date of Patent: Jul. 28, 2015

(54) RECORDING MEDIUM CONTAINING CASSETTE AND IMAGE FORMING APPARATUS INCLUDING THE SAME

(71) Applicant: KYOCERA DOCUMENT SOLUTIONS INC., Osaka (JP)

(72) Inventor: Kazuhisa Hirahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/109,593

(22) Filed: Dec. 17, 2013

(65) Prior Publication Data

US 2014/0175735 A1 Jun. 26, 2014

(30) Foreign Application Priority Data

Dec. 20, 2012 (JP) ..... 2012-277610

(51) Int. Cl.

| | |
|---|---|
| ***B65H 1/00*** | (2006.01) |
| ***B65H 1/12*** | (2006.01) |
| ***B65H 1/18*** | (2006.01) |
| ***G03G 15/00*** | (2006.01) |

(52) U.S. Cl.

CPC .. *B65H 1/12* (2013.01); *B65H 1/18* (2013.01); *G03G 15/6502* (2013.01)

(58) Field of Classification Search

CPC ..... B65H 1/04; B65H 1/266; B65H 1/14; B65H 2801/21; B65H 1/12; B65H 2511/10; B65H 3/54

USPC ..... 271/145, 162, 147, 148, 160, 171, 169, 271/170, 157

See application file for complete search history.

(56) References Cited

U.S. PATENT DOCUMENTS

| | | | | | |
|---|---|---|---|---|---|
| 4,828,245 | A * | 5/1989 | Shimogawara | ..... | 271/171 |
| 5,934,667 | A * | 8/1999 | Miki | ..... | 271/152 |
| 2013/0214483 | A1 * | 8/2013 | Hirahara | ..... | 271/264 |

FOREIGN PATENT DOCUMENTS

| | | | |
|---|---|---|---|
| JP | 4-7218 | * | 1/1992 |
| JP | 2005-170575 | A | 6/2005 |
| JP | 2005-187095 | A | 7/2005 |
| JP | 2012-162400 | A | 8/2012 |

OTHER PUBLICATIONS

An Office Action; "Notice of Reasons for Rejection," issued by the Japanese Patent Office on Feb. 24, 2015, which corresponds to Japanese Patent Application No. 2012-277610 and is related to U.S. Appl. No. 14/109,593.

* cited by examiner

*Primary Examiner* — Thomas Morrison
(74) *Attorney, Agent, or Firm* — Studebaker & Brackett PC

(57) ABSTRACT

A recording medium containing cassette includes a recording medium support plate and a width cursor. The width cursor positions a stack of recording media in a widthwise direction perpendicular to a conveyance direction of a recording medium. The recording medium support plate is allowed to swing so that a downstream portion in the conveyance direction of the recording medium support plate is moved upward and downward. The width cursor includes a first limiting portion and a second limiting portion. The first limiting portion limits the upward movement of the recording medium support plate when an amount of the stack of recording media is larger than a predetermined value. The second limiting portion limits the upward movement of the recording medium support plate when the amount of the stack of recording media is smaller than the predetermined value.

15 Claims, 9 Drawing Sheets

RECORDING MEDIUM CONTAINING CASSETTE AND IMAGE FORMING APPARATUS INCLUDING THE SAME

INCORPORATION BY REFERENCE

The present application claims priority under 35 U.S.C. §119 to Japanese Patent Application No. 2012-277610, filed Dec. 20, 2012. The contents of this application are incorporated herein by reference in their entirety.

BACKGROUND

The present disclosure relates to recording medium containing cassettes for containing sheet-like recording media, which are used in image forming apparatuses, such as digital photocopiers and laser printers, and image forming apparatuses including such a recording medium containing cassette.

A paper feed cassette (recording medium containing cassette) which is removably mounted in the body of an image forming apparatus has been commonly used. The paper feed cassette contains a stack of sheets of paper (recording medium). The paper feed cassette feeds paper to an image forming section in the body of the image forming apparatus in accordance with image forming operation, one sheet at a time. The paper feed cassette includes a paper support plate (recording medium support plate) on which a stack of paper is placed. The paper support plate is allowed to swing.

A typical configuration of the paper feed cassette will be described. FIGS. 8-10 are cross-sectional side views showing an example of a typical paper feed cassette 510. As shown in FIG. 8, the paper feed cassette 510 includes a paper support plate 528 on which a stack of paper 526 is placed. The paper support plate 528 is configured to be swung by a biasing member, such as a spring 532, so that a downstream portion in a paper conveyance direction (a right side of FIG. 8) thereof is moved upward and downward.

The stack of paper 526 placed on the paper support plate 528 of the paper feed cassette 510 is pressed against a pickup roller 529 which is provided on the apparatus body at a predetermined pressure which is exerted by the paper support plate 528 being urged upward by the spring 532. At this time, if a print start button of the image forming apparatus is pushed or switched on, the pickup roller 529 and a feed roller 530*a* of a feed roller pair 530 are driven to rotate in a direction indicated by an arrow in FIG. 8.

Typically, several top sheets of paper 526 placed on the paper support plate 528 are fed by the pickup roller 529 to the feed roller pair 530. The feed roller pair 530 includes the feed roller 530*a* and a separating roller 530*b*. The separating roller 530*b* is pressed against or withdrawn from the feed roller 530*a*. The separating roller 530*b* includes a torque limiter. Therefore, only when the rotational load exceeds a predetermined torque, the separating roller 530*b* is rotated by friction drive depending on the rotation of the feed roller 530*a*. Only the topmost sheet is separated by the separating roller 530*b* from the sheets of the paper 526 fed to the feed roller pair 530 and is then conveyed to a paper conveyance path 511. A trailing edge cursor 531 for evening or aligning the trailing edges of sheets of paper 526 is provided in a cassette base 525 and allowed to move along the paper conveyance direction (the left-right direction in FIGS. 8-10).

In the paper feed cassette 510, a limiting protrusion 525*b* for limiting the upward movement of the paper support plate 528 is provided on a wall portion 525*a* of the cassette base 525. Therefore, as shown in FIG. 9, when there is a large stack of paper 526, the limiting protrusion 525*b* presses the paper 526 so that the paper 526 and the paper support plate 528 are restrained from sticking out above the paper feed cassette 510.

During paper feed operation, the pickup roller 529 is rotated to feed the paper 526 while being situated in a lower position to press the paper 526. At this time, the paper 526 is pressed down by the pickup roller 529, and therefore, does not come into contact with the limiting protrusion 525*b*. Therefore, the skew of the paper 526 is reduced.

When there is a small stack of paper 526 in the paper feed cassette 510, as shown in FIG. 10, the inclination angle of the paper support plate 528 that is in contact with the limiting protrusion 525*b* is large. When there is no stack of paper 526, the paper support plate 528 reaches the maximum height. In this case, the paper support plate 528 sticks out above the paper feed cassette 510. Therefore, when the paper feed cassette 510 is inserted into or pulled out of the body of the image forming apparatus, the paper 526 and the paper support plate 528 touch the frame of the apparatus body. Note that if the size of the paper support plate 528 is reduced, the inclination angle of the paper support plate 528 increases, resulting in a higher maximum height of the paper support plate 528.

SUMMARY

According to a first aspect of the present disclosure, a recording medium containing cassette is removably mounted in a body of an image forming apparatus. The recording medium containing cassette includes a recording medium support plate, a biasing member, and a width cursor. A stack of recording media is placed on the recording medium support plate. The biasing member biases upward the recording medium support plate. The width cursor positions the stack of recording media in a widthwise direction perpendicular to a conveyance direction of the recording medium. The recording medium support plate is allowed to swing so that a downstream portion in the conveyance direction of the recording medium support plate is moved upward and downward. The width cursor includes a first limiting portion and a second limiting portion. The first limiting portion limits the upward movement of the recording medium support plate when the recording medium containing cassette is outside the body of the image forming apparatus and an amount of the stack of recording media is larger than a predetermined value. The second limiting portion limits the upward movement of the recording medium support plate when the recording medium containing cassette is outside the body of the image forming apparatus and the amount of the stack of recording media is smaller than the predetermined value.

According to a second aspect of the present disclosure, an image forming apparatus includes a recording medium containing cassette and an image forming unit. The recording medium containing cassette is removably mounted in a body of the image forming apparatus. The image forming unit forms an image on the recording medium. The recording medium containing cassette includes a recording medium support plate a biasing member, and a width cursor. The recording medium support plate is configured to allow a stack of recording media to be placed thereon. The biasing member is configured to bias upward the recording medium support plate. The width cursor is configured to position the stack of recording media in a widthwise direction perpendicular to a conveyance direction of the recording medium. The recording medium support plate is allowed to swing so that a downstream portion in the conveyance direction of the recording medium support plate is moved upward and downward, raised. The width cursor includes a first limiting portion and a second limiting portion. The first limiting portion is configured to limit the upward movement of the recording medium support plate when the recording medium containing cassette is outside the body of the image forming apparatus and an amount of the stack of recording media is larger than a predetermined value. The second limiting portion is configured to limit the upward movement of the recording medium support plate when the recording medium containing cassette is outside the body of the image forming apparatus and the amount of the stack of recording media is smaller than the predetermined value.

DETAILED DESCRIPTION

An embodiment of the present disclosure will now be described with reference to the accompanying drawings.

Figure 1:
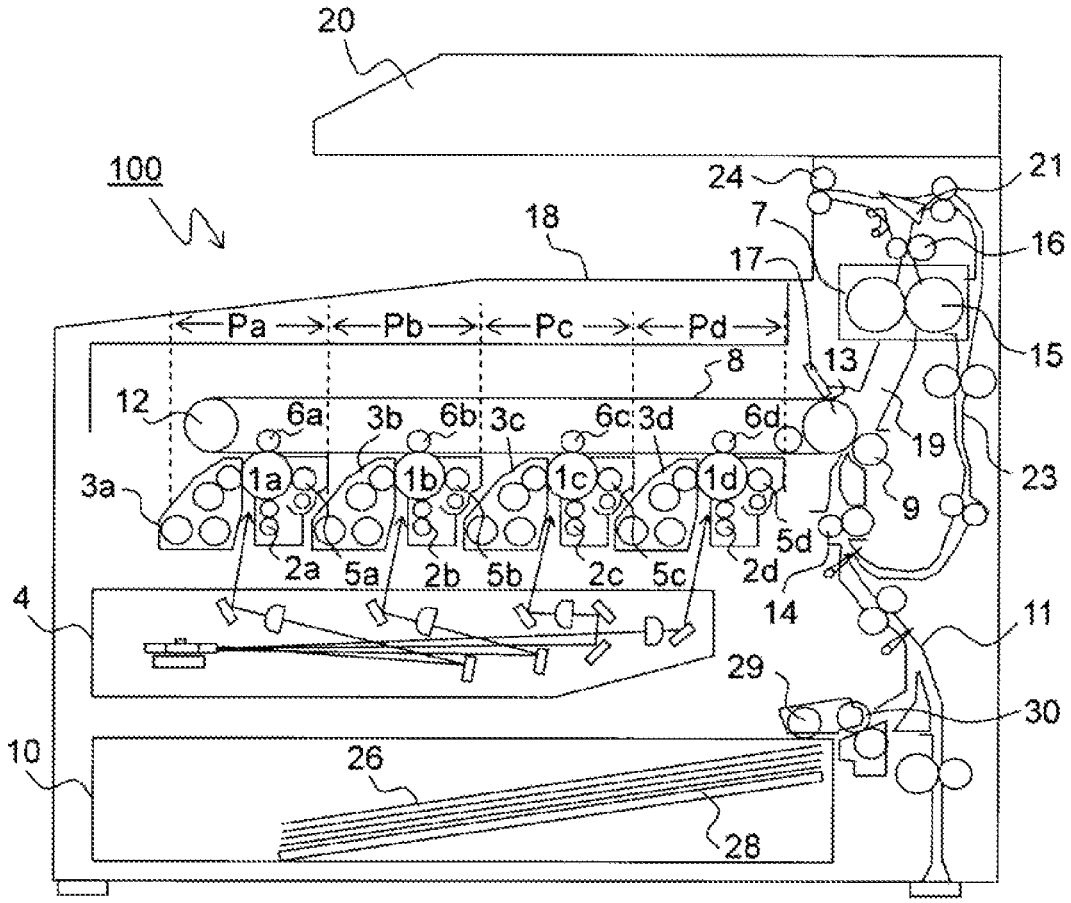
FIG. 1 is a cross-sectional view schematically showing a structure of an image forming apparatus including a paper feed cassette according to one embodiment of the present disclosure.

An image forming apparatus 100 including a paper feed cassette (recording medium containing cassette) 10 according to one embodiment of the present disclosure will be described with reference to FIGS. 1-7. As shown in FIG. 1, the image forming apparatus 100 is, for example, a tandem color photocopier. In the body of the image forming apparatus 100, four image forming sections Pa, Pb, Pc, and Pd are sequentially arranged from left to right in FIG. 1. The image forming sections Pa-Pd, which correspond to images of different four colors (yellow, magenta, cyan, and black), sequentially form yellow, magenta, cyan, and black images, respectively, by performing charging, exposing, developing, and transferring steps.

The image forming section Pa includes a photosensitive drum 1*a* which bears a yellow visible image (toner image). The image forming section Pb includes a photosensitive drum 1*b* which bears a magenta visible image (toner image). The image forming section Pc includes a photosensitive drum 1*c* which bears a cyan visible image (toner image). The image forming section Pd includes a photosensitive drum 1*d* which bears a black visible image (toner image). An intermediate transfer belt 8 is provided adjacent to the image forming sections Pa-Pd. The intermediate transfer belt 8 rotates counterclockwise in FIG. 1.

The toner images on the photosensitive drums 1*a*-1*d* are sequentially transferred to and superimposed together on the intermediate transfer belt 8 which is in contact with the photosensitive drums 1*a*-1*d*. The toner images superimposed together on the intermediate transfer belt 8 are transferred to paper 26 by an action of a second-order transfer roller 9, and are then fixed to the paper 26 by a fixing device 7. After the fixation of the toner images, the paper 26 is discharged from the body of the image forming apparatus 100. An image forming process is performed on each of the photosensitive drums 1*a*-1*d* while the photosensitive drums 1*a*-1*d* are rotated clockwise in FIG. 1. The paper 26 is an example of a sheet-like recording medium.

The paper 26 to which a toner image is to be transferred is contained in the paper feed cassette 10 which is provided in a lower portion of the body of the image forming apparatus 100. A stack of sheets of paper 26 is placed on a paper support plate (recording medium support plate) 28 of the paper feed cassette 10 (a stack of sheets of paper or a stack of recording media may be a single sheet of paper or a single recording medium). The feed of the paper 26 is started by rotating the pickup roller 29 while the upper surface of the paper 26 is pressed against the pickup roller 29 at a predetermined pressure. A feed roller pair 30 separates only the topmost sheet from the sheets of the paper 26, and then conveys that sheet toward a paper conveyance path 11. The paper 26 is passed through the paper conveyance path 11 to reach a registration roller pair 14, and is then conveyed to a nip portion between the second-order transfer roller 9 and a drive roller 13 of the intermediate transfer belt 8 in accordance with the timing of image formation.

A cleaning blade 17 is provided downstream of the second-order transfer roller 9 in the direction of movement of the intermediate transfer belt 8. The cleaning blade 17 removes residual toner from a surface of the intermediate transfer belt 8.

An image capture section 20 includes a scanning optical system, a condenser lens, a charge coupled device (CCD) sensor (none shown), etc. The image capture section 20 captures and converts an image of an original into image data.

Next, the image forming sections Pa-Pd will be described. The image forming section Pa includes the photosensitive drum 1*a*, a charging device 2*a*, a developing device 3*a*, and a cleaning device 5*a*. The image forming section Pb includes the photosensitive drum 1*b*, a charging device 2*b*, a developing device 3*b*, and a cleaning device 5*b*. The image forming section Pc includes the photosensitive drum 1*c*, a charging device 2*c*, a developing device 3*c*, and a cleaning device 5*c*. The image forming section Pd includes the photosensitive drum 1*d*, a charging device 2*d*, a developing device 3*d*, and a cleaning device 5*d*. A single exposing device 4 is used for all of the image forming sections Pa-Pd.

The image forming sections Pa-Pd, the exposing device 4, the intermediate transfer belt 8, an idler roller 12, the drive roller 13, first-order transfer rollers 6*a*-6*d*, the second-order transfer roller 9, and the cleaning blade 17 form an image forming unit. The image forming unit forms an image on the paper 26.

Figure 2:
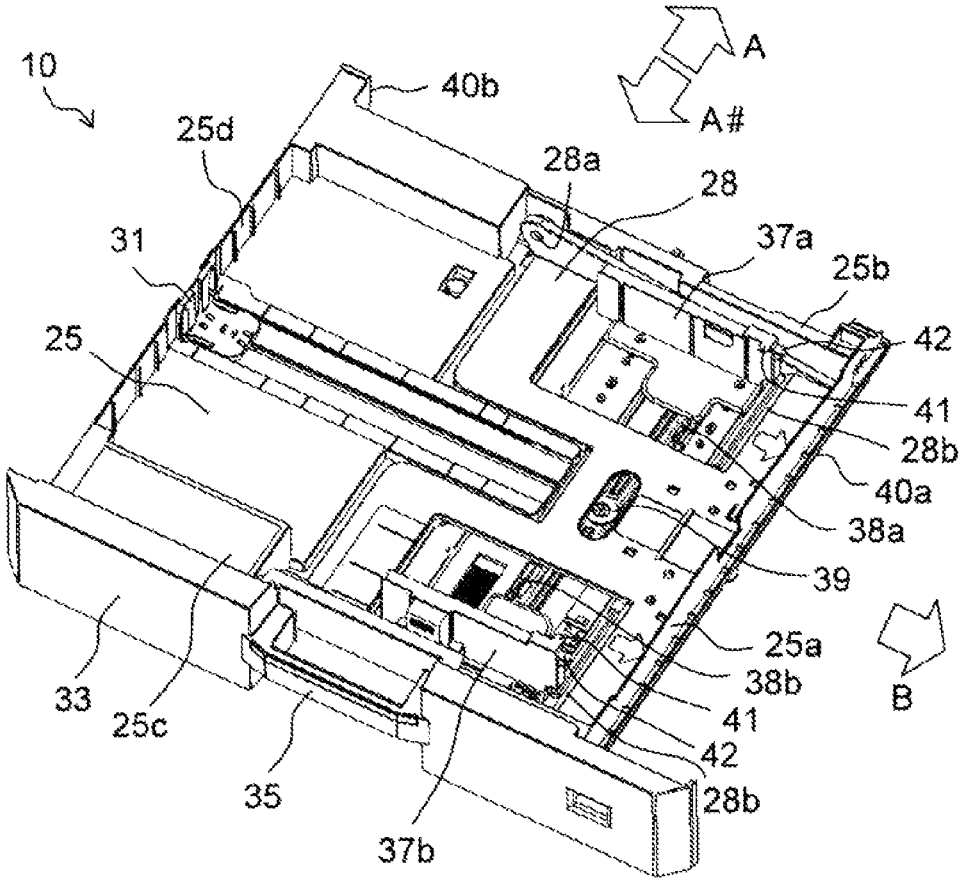
FIG. 2 is a perspective view showing a structure of the paper feed cassette of the embodiment of the present disclosure.
Figure 3:
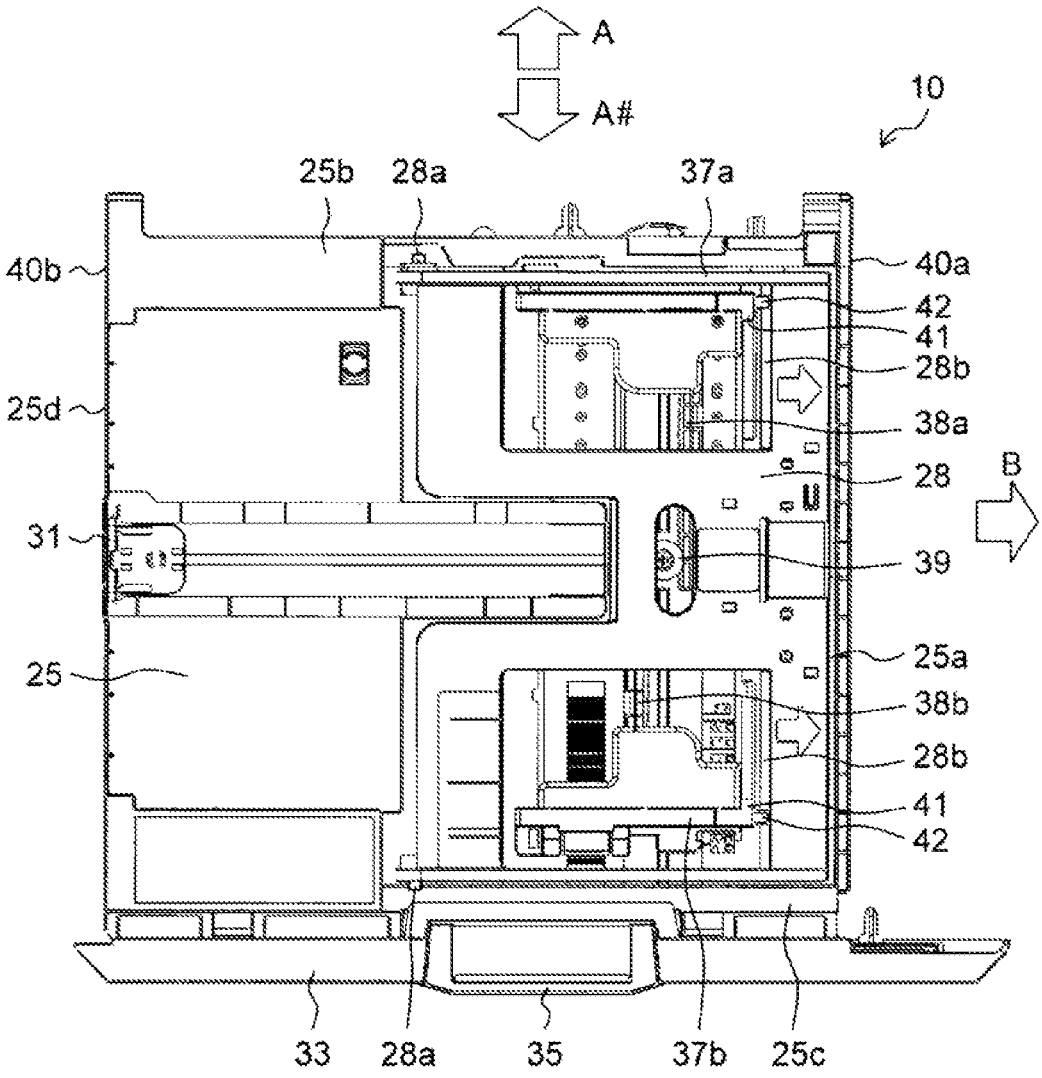
FIG. 3 is a plan view showing a structure of the paper feed cassette of the embodiment of the present disclosure.

Next, a configuration of the paper feed cassette 10 will be described. The paper feed cassette 10 is removably mounted in the body of the image forming apparatus 100. In FIG. 2, a direction in which the paper feed cassette 10 is inserted into the image forming apparatus 100 is indicated by an arrow A. A direction in which the paper feed cassette 10 is pulled out is indicated by an arrow A#. A direction in which the paper feed cassette 10 feeds paper (i.e., a direction in which the paper 26 or a recording medium is conveyed) is indicated by an arrow B. The conveyance direction of the paper 26 in the paper feed cassette 10 is hereinafter referred to as a "paper conveyance direction." Wall portions 25*a*-25*d* are provided in an upright position at four side edge portions of a cassette base 25. The cassette base 25 serves as a housing of the paper feed cassette 10.

A cassette cover 33 is attached to the wall portion 25*c*, which is located on the upstream side of the paper feed cassette 10 in a direction in which the paper feed cassette 10 is inserted. A front surface (on a lower side of FIG. 3) of the cassette cover 33, which is exposed to the outside, is a part of an outer surface of the body of the image forming apparatus 100 (see FIG. 1). A pull handle 35 which is used to insert and remove the paper feed cassette 10 is provided at a middle portion of the cassette cover 33.

A guide rail 40*a* and a guide rail 40*b* are provided on the wall portions 25*a* and 25*d*, respectively, which are parallel to the direction in which the paper feed cassette 10 is inserted or pulled out (the direction indicated by the arrow A or the direction indicated by the arrow A#). Two rail support portions (not shown) which support the guide rails 40*a* and 40*b* for sliding movement are provided on the body of the image forming apparatus 100. By causing the guide rails 40*a* and 40*b* to slide along the rail support portions, the paper feed cassette 10 can be inserted into and pulled out of the body of the image forming apparatus 100.

The paper support plate 28, on which the paper 26 (see FIG. 1) is placed, is allowed to swing about swing shafts (pivots) 28*a* provided at opposite ends in the directions of the arrows A and A#. In other words, base end portions of the paper support plate 28 are rotatably supported by the swing shafts 28*a*. A portion (leading end portion) of the paper support plate 28 which is located downstream of the base end portion of the paper support plate 28 in the paper feed direction (indicated by the arrow B) is moved upward and downward in relation to the cassette base 25, for example, by a compression coil spring 32 (see FIG. 5). In other words, the paper support plate 28 is allowed to swing so that the downstream portion (leading end portion) of the paper support plate 28 in the paper feed direction (paper conveyance direction) is moved upward and downward. The compression coil spring 32 is an example of a biasing member which biases upward the paper support plate 28.

A pair of widthwise edge aligning cursors (width cursor or widthwise positioning member) 37*a* and 37*b* are provided at opposite ends of the paper support plate 28 in a widthwise direction (the directions indicated by the arrows A and A#, i.e., a direction perpendicular to the paper feed direction) of the paper support plate 28. The widthwise edge aligning cursors 37*a* and 37*b* position the stack of paper 26 placed on the paper support plate 28 in the widthwise direction (the directions indicated by the arrows A and A#). In other words, the widthwise edge aligning cursors 37*a* and 37*b* position the stack of paper 26 along the widthwise direction perpendicular to the paper conveyance direction.

The widthwise edge aligning cursors 37*a* and 37*b* are each allowed to reciprocally move along guide rails (not shown) provided on the cassette base 25 in the widthwise direction of the paper 26. The widthwise edge aligning cursors 37*a* and 37*b* extend in the paper feed direction. The widthwise edge aligning cursors 37*a* and 37*b* have opposed wall portions (paper contact wall portions) with which edges of the paper 26 come into contact.

The widthwise edge aligning cursors 37*a* and 37*b* have a rack portion 38*a* and a rack portion 38*b*, respectively, which extend in the directions indicated by the arrows A and A#. The two rack portions 38*a* and 38*b* are engaged with a pinion gear 39. Therefore, when one of the widthwise edge aligning cursors 37*a* and 37*b* is moved (slid) in the widthwise direction of the paper 26, the resultant drive force is transmitted via the pinion gear 39 to the other widthwise edge aligning cursor 37*a* or 37*b*. As a result, the widthwise edge aligning cursors 37*a* and 37*b* are moved (slid) in the opposite directions by the same distance.

Figure 4:
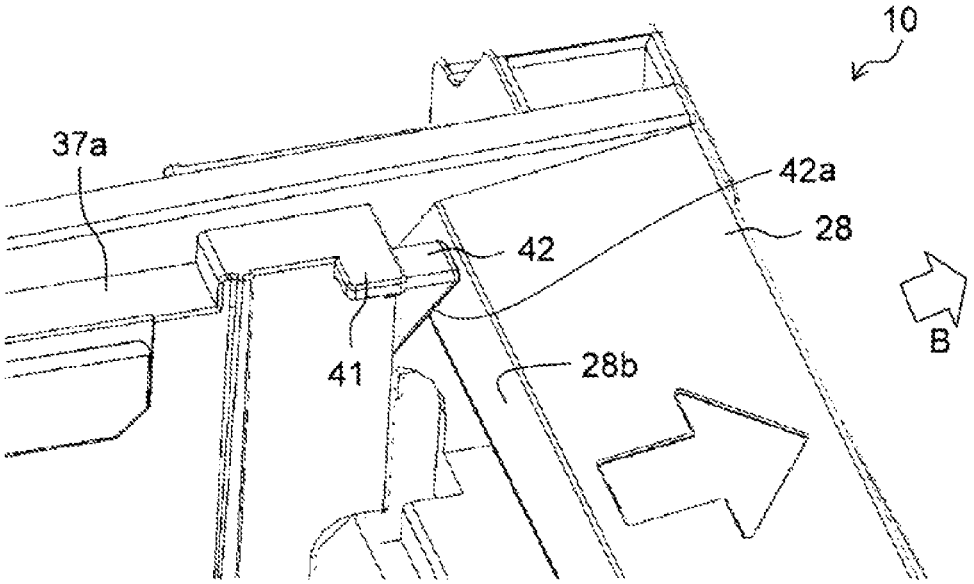
FIG. 4 is an enlarged perspective view showing structures of first and second limiting protrusions and their surroundings of the paper feed cassette of the embodiment of the present disclosure.

As shown in FIGS. 2 and 4, the paper contact wall portions of the widthwise edge aligning cursors 37*a* and 37*b* each have a first limiting protrusion (first limiting portion) 41 and a second limiting protrusion (second limiting portion) 42. The first and second limiting protrusions 41 and 42 are provided at downstream end parts of the widthwise edge aligning cursors 37*a* and 37*b* in the paper conveyance direction (direction indicated by the arrow B).

The first limiting protrusions 41 are provided at uppermost portions of the widthwise edge aligning cursors 37*a* and 37*b*, protruding from the widthwise edge aligning cursors 37*a* and 37*b* in the widthwise direction toward a middle of the paper feed cassette 10.

The second limiting protrusions 42 protrude from the widthwise edge aligning cursors 37*a* and 37*b* downstream in the paper conveyance direction. The second limiting protrusion 42 is provided in a lower position than that of the first limiting protrusion 41 and downstream of the first limiting protrusion 41 in the paper conveyance direction. The second limiting protrusion 42 is arranged external to the paper 26 placed on the paper support plate 28.

Figure 5:
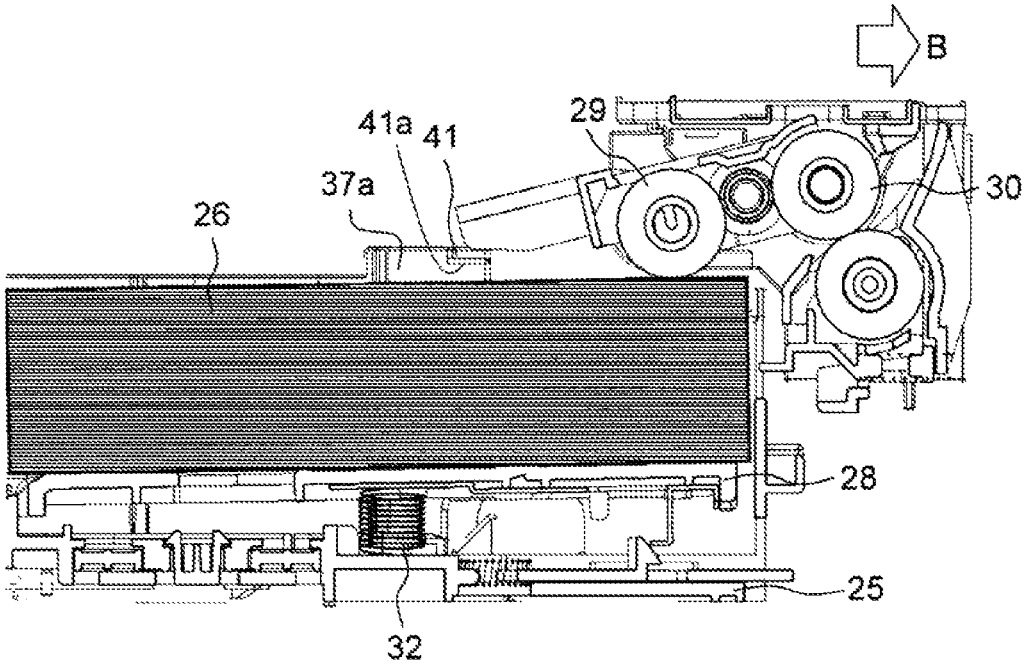
FIG. 5 is a cross-sectional view showing a structure of the paper feed cassette of the embodiment of the present disclosure and structures of a pickup roller and its surroundings.
Figure 6:
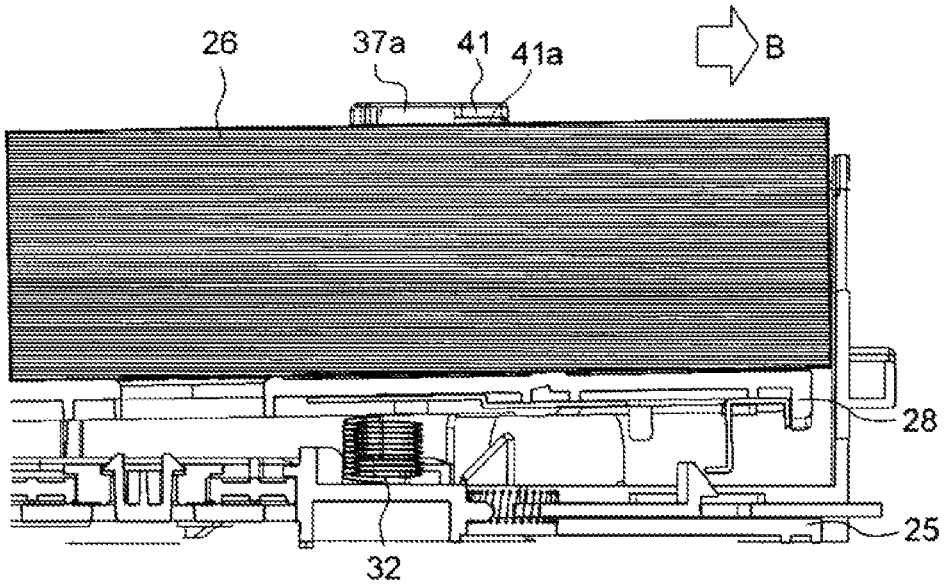
FIG. 6 is a cross-sectional view showing the paper feed cassette of the embodiment of the present disclosure when it contains a stack of paper whose amount is larger than a predetermined value.
Figure 7:
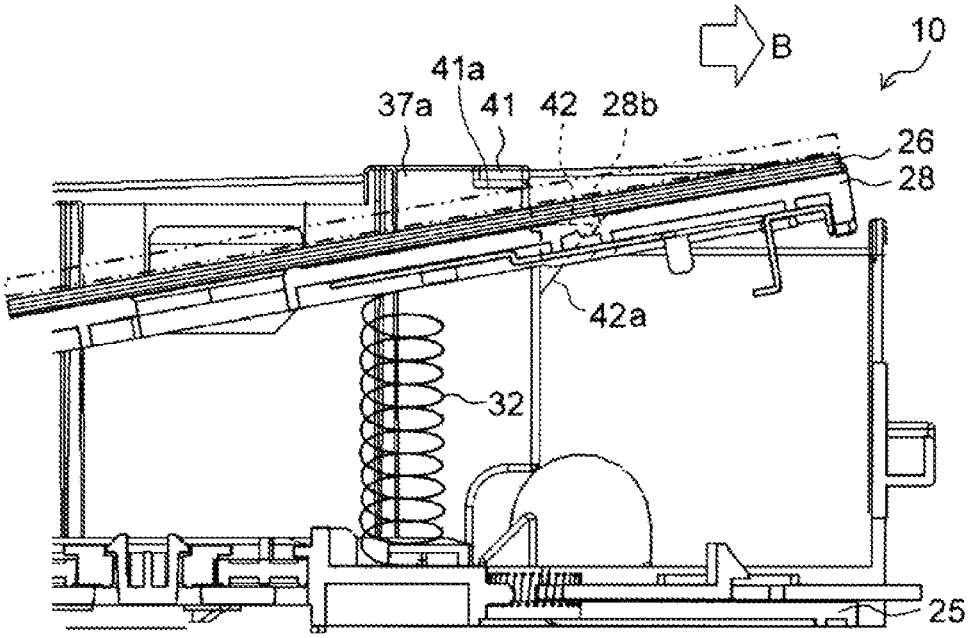
FIG. 7 is a cross-sectional view showing the paper feed cassette of the embodiment of the present disclosure when it contains a stack of paper whose amount is smaller than the predetermined value.
Figure 8:
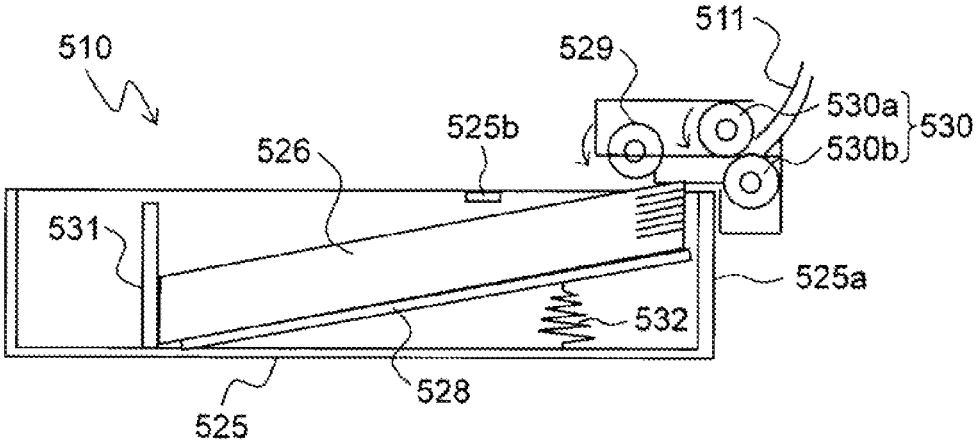
FIG. 8 is a cross-sectional side view showing a typical paper feed cassette.
Figure 9:
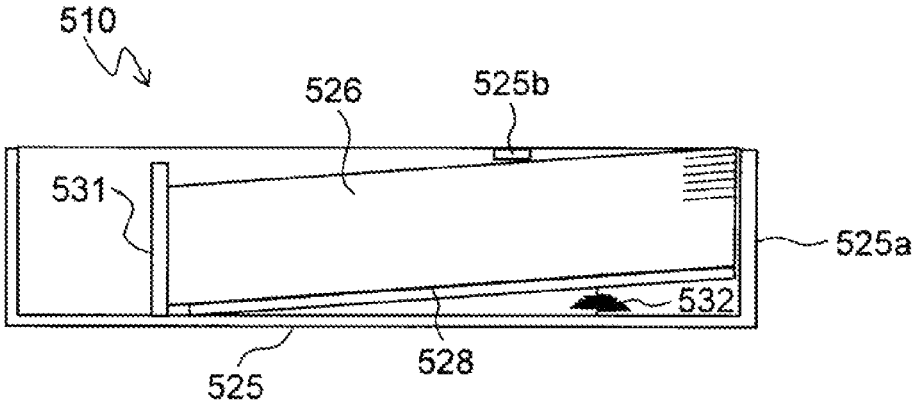
FIG. 9 is a cross-sectional view showing the typical paper feed cassette when it contains a stack of paper whose amount is larger than a predetermined value.
Figure 10:
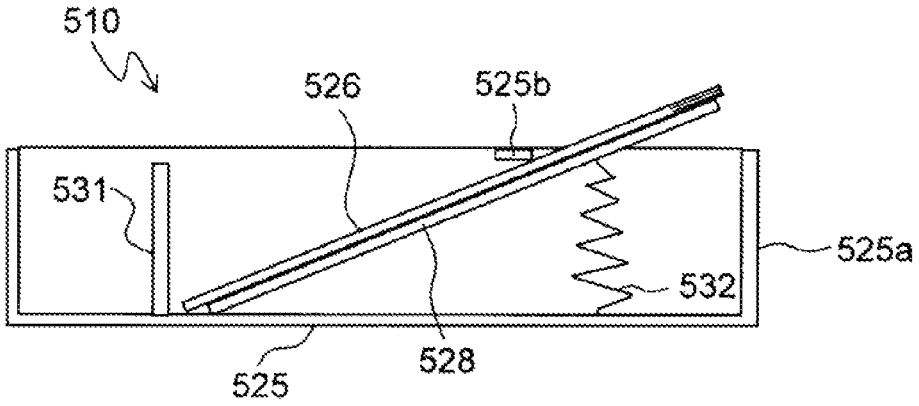
FIG. 10 is a cross-sectional view showing the typical paper feed cassette when it contains a stack of paper whose amount is smaller than the predetermined value.

As shown in FIG. 5, when the pickup roller 29 is situated in a lower position to press the paper 26, the first limiting protrusions 41 are not in contact with the paper 26. On the other hand, as shown in FIG. 6, when the pickup roller 29 is situated in a higher position, then if an amount of the stack of paper 26 is larger than a predetermined value, the first limiting protrusion 41 presses the paper 26. As shown in FIG. 7, when the pickup roller 29 is situated in the higher position, then if the amount of the stack of paper 26 is smaller than the predetermined value (this encompasses the absence of paper on the paper support plate 28), the second limiting protrusions 42 press a contact portion 28*b* (see FIG. 4) of the paper support plate 28. Note that FIGS. 6 and 7 show the paper feed cassette 10 which is removed from the body of the image forming apparatus 100.

As shown in FIG. 2, a trailing edge cursor 31 is provided to even or align the trailing edges of sheets of paper 26. Since the paper 26 is fed in the direction indicated by the arrow B toward the paper conveyance path 11 (see FIG. 1), the trailing edge cursor 31 is disposed to be movable reciprocally along a guide rail (not shown) provided on the cassette base 25 in parallel to the paper conveyance direction (the direction indicated by the arrow B).

If the widthwise edge aligning cursors 37*a* and 37*b* and the trailing edge cursor 31 are moved to positions corresponding to the size of placed paper, the paper 26 can be contained at a predetermined position in the paper feed cassette 10.

As shown in FIG. 6, in the image forming apparatus 100 including the paper feed cassette 10 of this embodiment, if the amount of the stack of paper 26 is larger than the predetermined value, then when the pickup roller 29 is situated in the higher position, the topmost sheet of paper 26 comes into contact with the first limiting protrusion 41. In other words, when the amount of the stack of paper 26 is larger than the predetermined value, the first limiting protrusion 41 is in contact with the paper 26. As a result, the upward movement of the paper support plate 28 is limited, and therefore, the paper support plate 28 and the paper 26 are restrained from sticking out above the paper feed cassette 10. Note that the first limiting protrusion 41 has a flat surface 41*a* (see FIGS. 5-7). The flat surface 41*a* extends along a horizontal direction. When the amount of the stack of paper 26 is larger than the predetermined value, the flat surface 41*a* is in contact with the paper 26.

On the other hand, as shown in FIG. 7, if the amount of the stack of paper 26 is smaller than the predetermined value, then when the pickup roller 29 is situated in the higher position, the downstream portion (leading end portion) in the paper conveyance direction of the paper support plate 28 is moved upward until the contact portion 28*b* of the paper support plate 28 comes into contact with the second limiting protrusion 42. In other words, when the amount of the stack of paper 26 is smaller than the predetermined value, the second limiting protrusion 42 is in contact with the paper support plate 28. As a result, the upward movement of the paper support plate 28 is limited, and therefore, the paper support plate 28 and the paper 26 are restrained from sticking out above the paper feed cassette 10. Note that the second limiting protrusion 42 has a sloping surface 42*a* (see FIGS. 4 and 7). The sloping surface 42*a* slopes upward toward the downstream side in the conveyance direction (the direction indicated by the arrow B). On the other hand, the contact portion 28*b* of the paper support plate 28 is a sloping surface which slopes upward toward the downstream side in the conveyance direction, and extends in the widthwise direction. When the amount of the stack of paper 26 is smaller than the predetermined value, the sloping surface 42*a* is in contact with the contact portion 28*b*.

Note that if the second limiting protrusion 42 is not provided, the paper 26 is lifted up to a position indicated by a dash-dot-dot line in FIG. 7, and therefore, the paper 26 and the paper support plate 28 stick out above the paper feed cassette 10. As described above, in this embodiment, the widthwise edge aligning cursors 37*a* and 37*b* each have the first and second limiting protrusions 41 and 42. The first limiting protrusion 41 limits the upward movement of the paper support plate 28 when the paper feed cassette 10 is outside the body of the image forming apparatus 100 and the amount of the stack of paper 26 is larger than the predetermined value. The second limiting protrusion 42 limits the upward movement of the paper support plate 28 when the paper feed cassette 10 is outside the body of the image forming apparatus 100 and the amount of the stack of paper 26 is smaller than the predetermined value.

Therefore, both when the amount of the stack of paper 26 is larger than the predetermined value and when the amount of the stack of paper 26 is smaller than the predetermined value, the upward movement of the paper support plate 28 can be limited. Therefore, the paper 26 and the paper support plate 28 can be restrained from sticking out above the paper feed cassette 10. As a result, when the paper feed cassette 10 is inserted into and removed from the body of the image forming apparatus 100, the paper 26 and the paper support plate 28 can be restrained from touching the frame of the body of the image forming apparatus 100.

As described above, the first limiting protrusion 41 presses the paper 26 when the amount of the stack of paper 26 is larger than the predetermined value, and the second limiting protrusion 42 presses the paper support plate 28 when the amount of the stack of paper 26 is smaller than the predetermined value. Therefore, when the amount of the stack of paper 26 is larger than the predetermined value, the first limiting protrusion 41 can easily restrain the upward movement of the paper support plate 28, and when the amount of the stack of paper 26 is smaller than the predetermined value, the second limiting protrusion 42 can easily restrain the upward movement of the paper support plate 28.

As described above, the first limiting protrusion 41 protrudes from each of the widthwise edge aligning cursors 37*a* and 37*b* along the widthwise direction toward a middle of the paper feed cassette 10. The second limiting protrusion 42 protrudes from each of the widthwise edge aligning cursors 37*a* and 37*b* downstream in the paper conveyance direction. Therefore, the paper 26 can be easily pressed by the first limiting protrusion 41, and the paper support plate 28 can be easily pressed by the second limiting protrusion 42.

As described above, the second limiting protrusion 42 is provided in a lower position than that of the first limiting protrusion 41. Therefore, when the amount of the stack of paper 26 is smaller than the predetermined value, the paper 26 and the paper support plate 28 can be easily restrained from sticking out above the paper feed cassette 10.

The embodiment described above is considered to be illustrative in all respects and not restrictive, the scope of the present disclosure being indicated by the appended claims rather than by the foregoing description. The present disclosure includes all modifications and equivalents as defined by the appended claims.

In the above embodiment, the widthwise edge aligning cursors 37*a* and 37*b* which are movable in the widthwise direction are provided at the opposite ends in the widthwise direction of the paper support plate 28. The present disclosure is not limited to this. For example, a widthwise edge aligning cursor (e.g., the widthwise edge aligning cursor 37*a*) may be provided only at one end in the widthwise direction of the paper support plate 28, and the widthwise edge aligning cursor and a wall portion (e.g., the wall portion 25*c*) of the cassette base 25 may be used to position the paper 26 in the widthwise direction. In this case, the first and second limiting protrusions 41 and 42 may be provided on the wall portion which is a widthwise positioning member.

In the above embodiment, the two first limiting protrusions 41 and the two second limiting protrusions 42 are provided. The present disclosure is not limited to this. Alternatively, only one first limiting protrusion 41 and only one second limiting protrusion 42 may be provided. In the above embodiment, the paper feed cassette 10 is inserted into and removed from the body of the image forming apparatus 100 in the direction perpendicular to the paper conveyance direction. The present disclosure is not limited to this. For example, the present disclosure is also applicable to a paper feed cassette which is inserted into and removed from the body of the image forming apparatus 100 in a direction parallel to the paper conveyance direction.

What is claimed is:

1. A recording medium containing cassette removably mounted in a body of an image forming apparatus, comprising:

a recording medium support plate configured to allow a stack of recording media to be placed thereon;

a biasing member configured to bias upward the recording medium support plate; and a width cursor configured to position the stack of recording media in a widthwise direction perpendicular to a conveyance direction of a recording medium, wherein the recording medium support plate is allowed to swing so that a downstream portion in the conveyance direction of the recording medium support plate is moved upward and downward, the width cursor includes a first limiting portion configured to come into contact with the recording media to limit the upward movement of the recording medium support plate when the recording medium containing cassette is outside the body of the image forming apparatus and an amount of the stack of recording media is larger than a predetermined value, and a second limiting portion configured to come into contact with the recording medium support plate to limit the upward movement of the recording medium support plate when the recording medium containing cassette is outside the body of the image forming apparatus and the amount of the stack of recording media is smaller than the predetermined value, the second limiting portion comes into contact with the recording medium support plate at a position located downstream in the conveyance direction of a position where the first limiting portion comes into contact with the recording media, and the second limiting portion is provided in a lower position than that of the first limiting portion.

2. A recording medium containing cassette according to claim 1, wherein the first limiting portion and the second limiting portion are provided at a downstream part of the width cursor in the conveyance direction.

3. A recording medium containing cassette according to claim 2, wherein the first limiting portion protrudes from the width cursor along the widthwise direction toward a middle of the recording medium containing cassette, and the second limiting portion protrudes from the width cursor downstream in the conveyance direction.

4. A recording medium containing cassette according to claim 3, wherein the second limiting portion is arranged external to the recording medium placed on the recording medium support plate.

5. A recording medium containing cassette according to claim 1, wherein the first limiting portion has a flat surface configured to be in contact with the stack of recording media when the amount of the stack of recording media is larger than the predetermined value, the flat surface extends in a horizontal direction, the second limiting portion has a sloping surface, the sloping surface slopes upward toward a downstream side in the conveyance direction, the recording medium support plate has an contact portion extending in the widthwise direction, the contact portion is a sloping surface which slopes upward toward the downstream side in the conveyance direction, and the sloping surface of the second limiting portion is in contact with the contact portion when the amount of the stack of recording media is smaller than the predetermined value.

6. A recording medium containing cassette according to claim 1, wherein the first limiting portion is in contact with a side end portion in the conveyance direction of a topmost recording medium of the recording media, the recording medium support plate includes a contact portion formed upstream of a downstream end in the conveyance direction of the recording medium support plate, and the second limiting portion is in contact with the contact portion of the recording medium support plate.

7. A recording medium containing cassette according to claim 1, wherein the first limiting portion does not limit the upward movement of the recording medium support plate when the amount of the stack of recording media is smaller than the predetermined value, and the second limiting portion does not limit the upward movement of the recording medium support plate when the amount of the stack of recording media is larger than the predetermined value.

8. A recording medium containing cassette according to claim 1, wherein the first and second limiting portions are immovably formed at the width cursor.

9. A recording medium containing cassette according to claim 1, wherein the first limiting portion does not come into contact with the recording media in a state in which a pickup roller that feeds the recording media is situated in a lower position to press the recording media, and comes into contact with the recording media when the amount of the stack of the recording media is larger than the predetermined value in a state in which the pickup roller is situated in an upper position, and the second limiting portion comes in contact with the recording medium support plate when the amount of the stack of the recording media is smaller than the predetermined value in a state in which the pickup roller is situated in the upper position.

10. A recording medium containing cassette removably mounted in a body of an image forming apparatus, comprising:

a recording medium support plate configured to allow a stack of recording media to be placed thereon;

a biasing member configured to bias upward the recording medium support plate; and a width cursor configured to position the stack of recording media in a widthwise direction perpendicular to a conveyance direction of a recording medium, wherein the recording medium support plate is allowed to swing so that a downstream portion in the conveyance direction of the recording medium support plate is moved upward and downward, the width cursor includes a first limiting portion configured to come into contact with the recording media to limit the upward movement of the recording medium support plate when the recording medium containing cassette is outside the body of the image forming apparatus and an amount of the stack of recording media is larger than a predetermined value, and a second limiting portion configured to come into contact with the recording medium support plate to limit the upward movement of the recording medium support plate when the recording medium containing cassette is outside the body of the image forming apparatus and the amount of the stack of recording media is smaller than the predetermined value, the second limiting portion comes into contact with the recording medium support plate at a position located downstream in the conveyance direction of a position where the first limiting portion comes into contact with the recording media, the first limiting portion has a flat surface configured to be in contact with the stack of recording media when the amount of the stack of recording media is larger than the predetermined value, the flat surface extends in a horizontal direction, the second limiting portion has a sloping surface, the sloping surface slopes upward toward a downstream side in the conveyance direction, the recording medium support plate has an contact portion extending in the widthwise direction, the contact portion is a sloping surface which slopes upward toward the downstream side in the conveyance direction, and the sloping surface of the second limiting portion is in contact with the contact portion when the amount of the stack of recording media is smaller than the predetermined value.

11. A recording medium containing cassette according to claim 10, wherein the first limiting portion and the second limiting portion are provided at a downstream part of the width cursor in the conveyance direction.

12. A recording medium containing cassette according to claim 11, wherein the first limiting portion protrudes from the width cursor along the widthwise direction toward a middle of the recording medium containing cassette, and the second limiting portion protrudes from the width cursor downstream in the conveyance direction.

13. A recording medium containing cassette according to claim 12, wherein the second limiting portion is arranged external to the recording medium placed on the recording medium support plate.

14. A recording medium containing cassette according to claim 10, wherein the first limiting portion is in contact with a side end portion in the conveyance direction of a topmost recording medium of the recording media, the recording medium support plate includes a contact portion formed upstream of a downstream end in the conveyance direction of the recording medium support plate, and the second limiting portion is in contact with the contact portion of the recording medium support plate.

15. A recording medium containing cassette removably mounted in a body of an image forming apparatus, comprising:

a recording medium support plate configured to allow a stack of recording media to be placed thereon;

a biasing member configured to bias upward the recording medium support plate; and a width cursor configured to position the stack of recording media in a widthwise direction perpendicular to a conveyance direction of a recording medium, wherein the recording medium support plate is allowed to swing so that a downstream portion in the conveyance direction of the recording medium support plate is moved upward and downward, the width cursor includes a first limiting portion configured to come into contact with the recording media to limit the upward movement of the recording medium support plate when the recording medium containing cassette is outside the body of the image forming apparatus and an amount of the stack of recording media is larger than a predetermined value, and a second limiting portion configured to come into contact with the recording medium support plate to limit the upward movement of the recording medium support plate when the recording medium containing cassette is outside the body of the image forming apparatus and the amount of the stack of recording media is smaller than the predetermined value, the second limiting portion comes into contact with the recording medium support plate at a position located downstream in the conveyance direction of a position where the first limiting portion comes into contact with the recording media, the first limiting portion does not come into contact with the recording media in a state in which a pickup roller that feeds the recording media is situated in a lower position to press the recording media, and comes into contact with the recording media when the amount of the stack of the recording media is larger than the predetermined value in a state in which the pickup roller is situated in an upper position, and the second limiting portion comes in contact with the recording medium support plate when the amount of the stack of the recording media is smaller than the predetermined value in a state in which the pickup roller is situated in the upper position.

* * * * *